US011761357B2

(12) United States Patent
Boyce-Erickson et al.

(10) Patent No.: US 11,761,357 B2
(45) Date of Patent: Sep. 19, 2023

(54) PRESSURE SHIFTED VALVE TIMING

(71) Applicant: Regents of the University of Minnesota, Minneapolis, MN (US)

(72) Inventors: Grey C. Boyce-Erickson, Minneapolis, MN (US); James D. Van de Ven, Minneapolis, MN (US); Thomas R. Chase, Minneapolis, MN (US)

(73) Assignee: REGENTS OF THE UNIVERSITY OF MINNESOTA, Minneapolis, MN (US)

( * ) Notice: Subject to any disclaimer, the term of this patent is extended or adjusted under 35 U.S.C. 154(b) by 181 days.

(21) Appl. No.: 17/471,645

(22) Filed: Sep. 10, 2021

(65) Prior Publication Data

US 2022/0074324 A1 Mar. 10, 2022

Related U.S. Application Data

(60) Provisional application No. 63/076,645, filed on Sep. 10, 2020.

(51) Int. Cl.
*F01L 1/344* (2006.01)

(52) U.S. Cl.
CPC ..... *F01L 1/3442* (2013.01); *F01L 2001/3445* (2013.01); *F01L 2001/34423* (2013.01)

(58) Field of Classification Search
CPC ..... F01L 1/3442; F01L 2001/34423; F01L 2001/3445; F04B 49/00; F04B 49/08
See application file for complete search history.

(56) References Cited

U.S. PATENT DOCUMENTS 9,759,239 B2 * 9/2017 Le Roux ..... F04B 25/005
2001/0023671 A1 * 9/2001 Vorih ..... F01L 13/06 123/90.27
2010/0212743 A1 * 8/2010 Li ..... F16K 7/10 137/1
2012/0006013 A1 * 1/2012 McBride ..... F15B 1/024 60/327

(Continued)

OTHER PUBLICATIONS

Boyce-Erickson et al., "Valve Timing and Area Profile Selection for Hydraulic Pumps and Motors" Proceedings of the 2020 Bath/ASME Symposium on Fluid Power and Motion Control FPMC2020; Sep. 9-11, 2020, University of Bath, Bath, United Kingdom.

(Continued)

*Primary Examiner* — Grant Moubry
(74) *Attorney, Agent, or Firm* — Brian D. Kaul; Westman, Champlin & Koehler, P.A.

(57) ABSTRACT

A hydraulic pump-motor includes a cylinder block including a plurality of fluid chambers, a piston in each of the fluid chambers, a cam, a fixed valve area profile, and a timing adjustment actuator. The cam includes a cam surface that engages the pistons and drives movement of the pistons relative to the fluid chambers in response to relative rotation between the cam and the fluid chambers. The fixed valve area profile is configured to control fluid flows between the fluid chambers and first and second ports. The timing adjustment actuator is configured to adjust an angular orientation of the fixed valve area profile relative to an angular orientation of the cam based on a pressure differential between a pressure at the first port and a pressure at the second port.

20 Claims, 8 Drawing Sheets

(56) References Cited

U.S. PATENT DOCUMENTS

| | | | | |
|---|---|---|---|---|
| 2012/0047884 | A1* | 3/2012 | Mcbride | F01K 27/00 60/398 |
| 2018/0266447 | A1* | 9/2018 | Imam | F15B 7/10 |
| 2020/0173314 | A1 | 6/2020 | Mueller | |
| 2020/0256332 | A1 | 8/2020 | Tonnqvist et al. | |

OTHER PUBLICATIONS

Edge, K.A. and Liu, Y: "Reduction of Piston Pump Pressure Ripple" Proceedings, International Conference on Fluid Power Transmission and Control, Issue Date: Mar. 1989, pp. 779-784.

Helmus, T. "Investigation and Implementation of Mechanically Actuated Valves for Digital Hydraulic Units" A Thesis Submitted to the Faculty of Purdue University in Partial Fulfillment of the Requirements for the degree of Master of Science in Engineering; Published by ProQuest LLC (2017).

* cited by examiner

PRESSURE SHIFTED VALVE TIMING

CROSS-REFERENCE TO RELATED APPLICATION

The present application is based on and claims the benefit of U.S. provisional patent application Ser. No. 63/076,645, filed Sep. 10, 2020, the content of which is hereby incorporated by reference in its entirety.

GOVERNMENT FUNDING

This invention was made with government support under the Vehicle Technologies Office Award Number DE-EE0008335 awarded by the U.S. Department of Energy's Office of Efficiency and Renewable Energy. The government has certain rights in the invention.

FIELD

Embodiments of the present disclosure relate to valve timing and area profiles for a hydraulic pump-motor and, more specifically, to pressure shifted valve timing techniques for reducing throttling while allowing the hydraulic pump-motor to efficiently operate over a wide pressure range.

BACKGROUND

All hydraulic motors and many hydraulic pumps require active valves to control flow entering and exiting the fluid chambers of the machine. The valves can be implemented using several solutions: port plates, spool valves, poppet valves, and rotary valves, to name a few. Ultimately, these valves accomplish the same task: creating an area through which fluid passes. This area controls the flow entering the fluid chambers. Ideally, the flow is not throttled while it is being controlled, only directed in and out of the cylinder. Additionally, it is desirable to reduce torque ripple, flow ripple, noise, and vibration caused by the valves in pumps and motors.

Throttling is a predominant loss in valve actuation. Throttling occurs whenever fluid passes through a restrictive valve area that creates a pressure drop. Poorly designed valve timing and area profiles can cause a substantial decrease in efficiency due to throttling losses. With a good valve timing, the pressure in the cylinder closely matches the pressure at the port to which the valve is opening. If the pressure is not matched, a rush of fluid goes through the valve, leading to a quick change in-cylinder pressure with significant throttling losses. In a motor, this can create torque ripple, and in a pump, flow ripple. The energy lost due to throttling is absorbed by the working fluid, raising the temperature of the fluid and requiring a larger cooling system.

Valve area profiles have been constrained by the selected valve or a parameterized area profile. Often an optimization is used to determine the geometry of a valve and its timing. For example, a port plate for an axial piston pump may be parameterized and optimized to run smoothly over a wide pressure range. However, relieving grooves or timing grooves are necessary to create smooth operation across the pressure range, such that pressure spikes and cavitation in the cylinder do not occur, such as during pressure reversals. However, disc valves or valve plates with timing grooves are less efficient than disc valves without timing grooves because of uncontrolled expansion through the slots. Thus, there is a trade-off between smoothing the pressure dynamics and a decrease in efficiency.

SUMMARY

Embodiments of the present disclosure relate to methods for optimizing valve timing of a hydraulic pump-motor using a pressure shifted valve timing approach. One embodiment of the motor includes a cylinder block including a plurality of fluid chambers, a piston in each of the fluid chambers, a cam, a fixed valve area profile, and a timing adjustment actuator. The cam includes a cam surface that engages the pistons and drives movement of the pistons relative to the fluid chambers in response to relative rotation between the cam and the fluid chambers. The fixed valve area profile is configured to control fluid flows between the fluid chambers and first and second ports during rotation of the fluid chambers relative to the cam and the fixed valve area profile. The timing adjustment actuator is configured to adjust an angular orientation of the fixed valve area profile relative to an angular orientation of the cam based on a pressure differential between a pressure at the first port and a pressure at the second port, during rotation of the cam and the fixed valve area profile relative to the fluid chambers.

In one embodiment, the timing adjustment actuator includes a housing and a vane actuator. The housing is connected to the fixed valve area profile. The vane actuator is contained within an actuator chamber of the housing. The vane actuator has a fixed angular orientation relative to the cam, and divides the actuator chamber into a first actuator chamber section connected to the first port and a second actuator chamber section connected to the second port. A non-zero pressure differential between the first and second ports creates a net pressure difference between the first and second actuator chambers and adjusts an angular orientation of the fixed valve area profile relative to an angular orientation of the cam during rotation of the cam and the fixed valve area profile relative to the fluid chambers.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
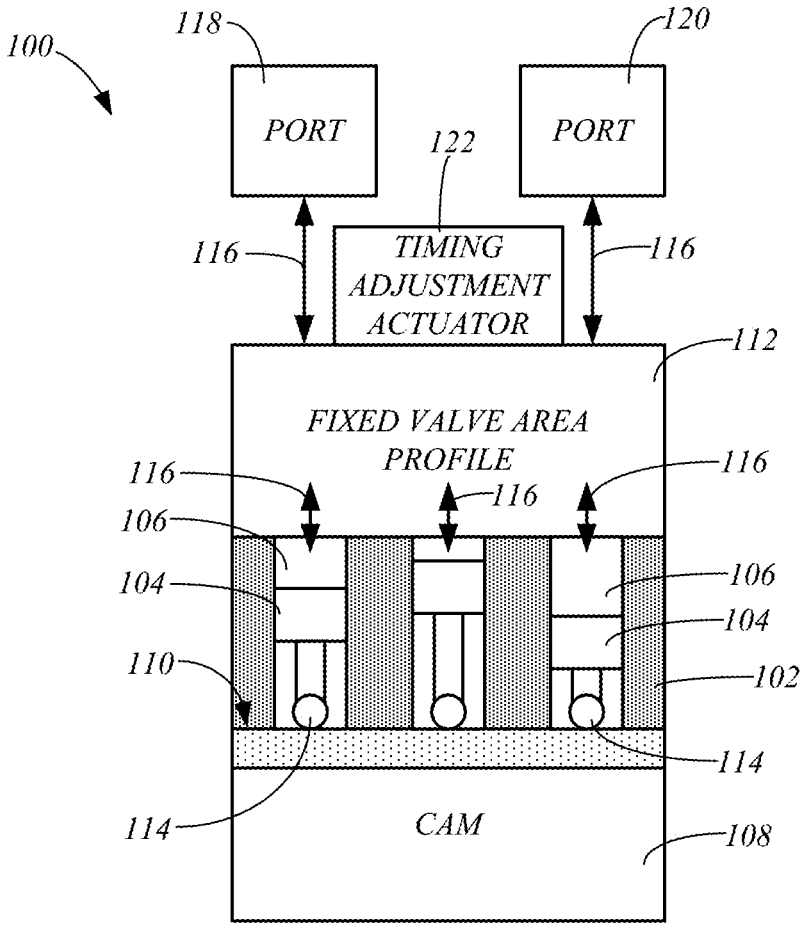
FIG. 1 is a simplified block diagram of an example of a hydraulic pump-motor, in accordance with embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Unless otherwise defined, all terms (including technical and scientific terms) used herein have the same meaning as commonly understood by one of ordinary skill in the art relating to the present disclosure. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 12:
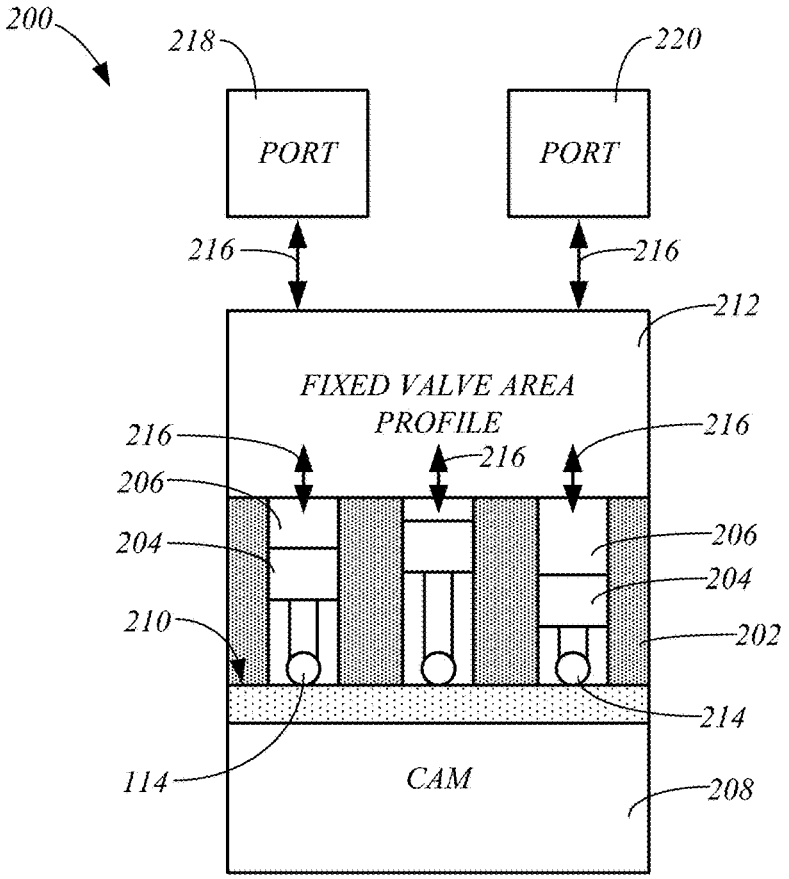
FIG. 12 (Prior Art)
FIG. 12 is a simplified diagram of a conventional hydraulic pump-motor.
Figure 13:
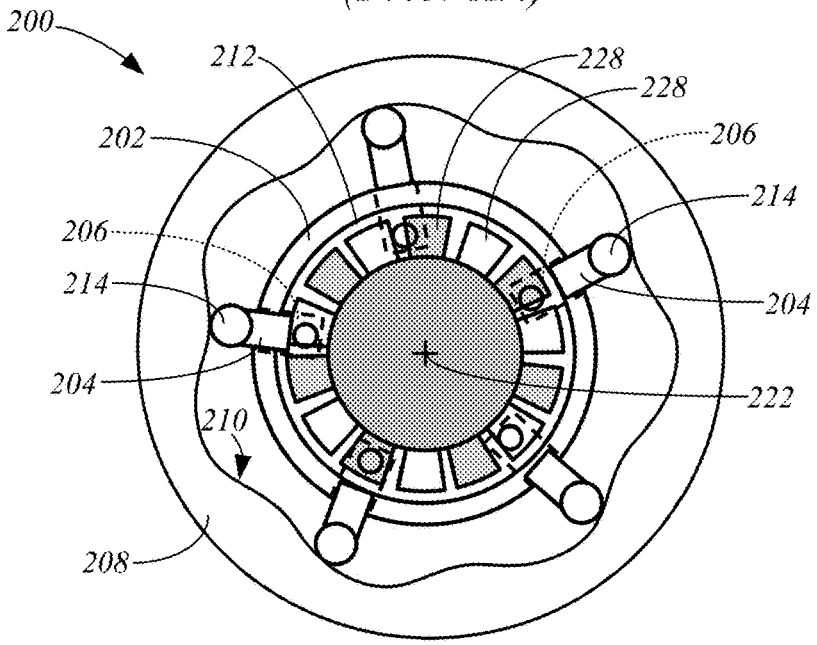
FIG. 13 (Prior Art)
FIGS. 13 and 14 are simplified side and top cross-sectional views of an example of a hydraulic pump-motor, in accordance with the prior art.
Figure 14:
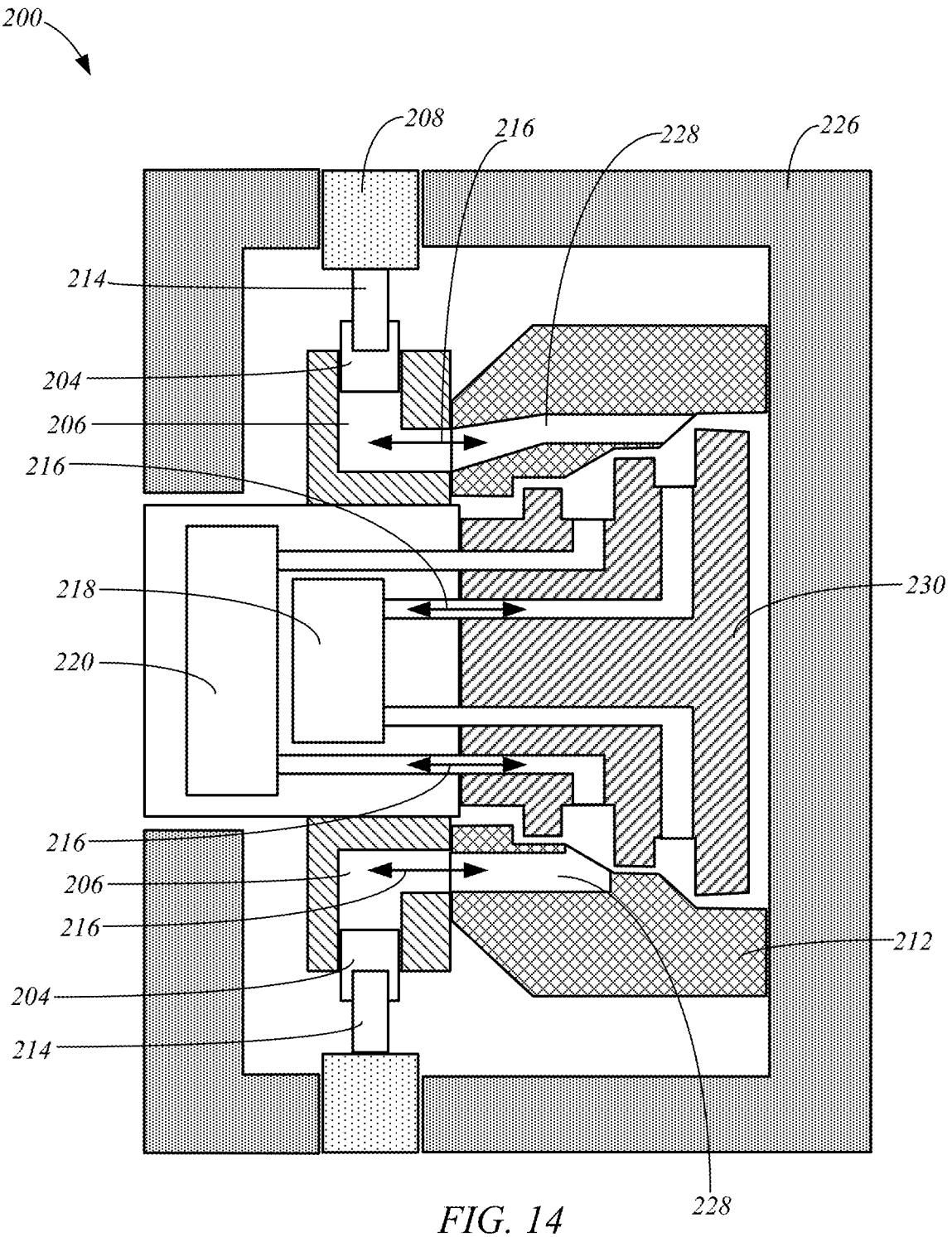
FIG. 14 (Prior Art)

An explanation of the conventional operation of a rotary hydraulic pump-motor will be provided with reference to FIGS. 12-14. FIG. 12 is a simplified diagram of a conventional rotary hydraulic pump-motor 200, and FIGS. 13 and 14 are simplified side and top cross-sectional views of an example of the rotary hydraulic pump-motor 200, in accordance with the prior art. Some components may not be shown in order to simplify the illustrations.

The conventional rotary hydraulic pump-motor (hereinafter "motor") 200 generally includes a cylinder block 202 having pistons 204 contained in fluid chambers 206, a cam 208 having a cam surface 210, and a fixed valve area profile 212. The fluid chambers 206 may be oriented in a radial or axial direction relative to a rotational axis of the motor 200. The pistons 204 may take on any suitable form, such as piston cylinders with cam followers 214 (as shown), ball pistons, or another suitable conventional piston. Each piston 204 or its cam follower 214 engages the cam surface 210, which drives movement of the piston 204 relative to its corresponding fluid chamber 206 in response to relative rotation between the cylinder block 202 and the cam 208. This movement of the pistons 204 drives fluid flows 216 (e.g., controls fluid expansion) through the fixed valve area profile 212 to ports 218 and 220.

The cam 208 and the corresponding cam surface 210 may take the form of a radial cam, a cam ring, a rotary cam, or another conventional form for operation with radially configured fluid chambers. Likewise, when the fluid chambers 206 are in an axial configuration, the cam 208 and cam surface 210 may take the form of a swash plate, a bent axis and ball plate arrangement for driving the pistons 204, or another conventional form for driving the pistons 204.

The fixed valve area profile 212 may also take on a conventional form, such as a port plate, spool valves, a disc valve, poppet valves, a pintle, or another conventional form. The fixed valve area profile 212 generally operates to control the fluid flows between the fluid chambers 206 and the ports 218, 220, as indicated in FIG. 12.

During operation, the cam 208 and the fixed valve area profile 212 rotate together relative to the cylinder block 202 and its fluid chambers 206. This means that, for some motors (e.g., radial pump-motor with disc valve, etc.), the cam 208 and the fixed valve area profile 212 are rotatably driven about an axis relative to the cylinder block 202, and for other motors (e.g., axial pump-motor, radial pump-motor with pintle, etc.), the cylinder block 202 is rotatably driven about an axis relative to the cam 208 and the fixed valve area profile 212.

During the rotation of the cam 208 and fixed valve area profile 212 relative to the cylinder block 202 and the fluid chambers 206, the fluid flows 216 generated by the movement of the pistons 204 are directed to the ports 218, 220 by the fixed valve area profile 212. Since the angular positions or orientations of the cam 208 and the fixed valve area profile 212 are fixed relative to each other, for a given angular position of the cam 208 and the fixed valve area profile 212 relative to the fluid chambers 206, there is generally a fixed route for the fluid flows 216 to travel to the ports 218, 220. As a result, the timing between the fixed valve area profile 212 and the cam 208, and between the fixed valve area profile 212 and the fluid chambers 206 is fixed.

In the example hydraulic pump-motor 200 of FIGS. 13 and 14, the fluid chambers 206 are in a radial configuration relative to the axis 222. The pistons 204 are each connected to a roller or cam follower 214 that engages the cam surface 210 of the cam 208, which is in the form of a radial cam.

The fixed valve area profile 212 comprises a disc valve that rotates about the axis 222 with the cam 208 and a casing 226 (FIG. 14). The fixed valve area profile 212 includes fluid pathways 228 that connect to either the port 218 or the port 220. In FIG. 13 the fluid pathways 228 that connect to the port 218 are illustrated without shading, and the fluid pathways 218 that connect to the port 220 are illustrated with shading.

During rotation of the cam 208 and the fixed valve area profile 212, the fluid pathways 228 move in and out of alignment with the fluid chambers 206 to allow the fluid flows 216 driven by the pistons 204 to travel to and from the appropriate port 218, 220, such as through a fluid distributor 230, as indicated in FIG. 14.

Efforts have been made to optimize the operating efficiency of such conventional motors 200, such as by optimizing the fixed valve area profile 212 and adding timing grooves. However, such optimizations are generally not successful at handling pressure spikes at the ports 218, 220, such as those associated with a reversal in the pressure differential between the ports.

Embodiments of the present disclosure are directed to pressure-shifted valve timing techniques for a hydraulic pump-motor that can better accommodate pressure spikes at the ports of the motor than conventional hydraulic pump-motors that utilize fixed valve timing arrangements due to the cam and fixed valve area profile having fixed angular orientations relative to each other. The pressure-shifted valve timing techniques allow for very efficient operation of hydraulic pump-motors over a wide range of pressures, and provide additional advantages over conventional designs.

FIG. 1 is a simplified block diagram of an example of a hydraulic pump-motor (hereinafter "motor") 100, in accordance with embodiments of the present disclosure. The example motor 100 includes some of the basic components discussed above with reference to FIG. 12. For example, the motor 100 includes a cylinder block 102 having pistons 104 contained in fluid chambers 106, a cam 108 having a cam surface 110, and a fixed valve area profile 112 that generally controls (e.g., routes) fluid flows 116 between the fluid chambers and ports 118 and 120. Embodiments of these components include conventional forms of the components, such as those described above with reference to FIGS. 12-14.

As a result, the motor 100 of FIG. 1 generally operates as discussed above. Each piston 104 engages the cam surface 110 (possibly through a cam follower 114), which drives movement of the piston 104 relative to its fluid chamber 106 in response to relative rotation between the cylinder block 102 and the cam 108 and cam surface 110. This movement of the pistons 104 drives fluid flows 116 (e.g., controls fluid expansion) that are routed between the fluid chambers 106 and the ports 118 and 120 by the fixed valve area profile 112.

However, unlike conventional hydraulic pump-motors, the motor 100 includes a timing adjustment actuator 122 that operates to adjust an angular orientation of the fixed valve area profile 112 relative to an angular orientation of the cam 108 based on a pressure differential between a pressure at the port 118 and a pressure at the port 120, during rotation of the cam 108 and the fixed valve area profile 112 relative to the fluid chambers 106. As mentioned above, depending on the type of motor 100, the relative rotation between cylinder block 102 and the cam 108 and the fixed valve area profile 112 may involve the cam 108 and the fixed valve area profile 112 being rotated about an axis while the cylinder block 102 remains stationary, or the cylinder block 102 may be rotated about an axis while the cam 108 and the fixed valve area profile 112 remain stationary. Thus, the timing adjustment actuator 122 may be used to adjust the timing between the cam 108 and the fixed valve area profile 112, as well as the fixed valve area profile 112 and the fluid chambers 106, which allows the motor 100 to better handle spikes in the pressure differential, such as during a reversal of the operation of the motor 100, for example.

As discussed below in greater detail, the timing adjustment actuator 122 may shift the angular orientation of the fixed valve area profile 112 relative to the angular orientation of the cam 108 based on a direction of the pressure differential, or a direction and magnitude of the pressure differential. For example, when the pressure differential is zero, the motor 100 may substantially operate in accordance with conventional hydraulic pump-motors, such as that described above regarding motor 200, by maintaining the fixed valve area profile 112 in a fixed angular orientation relative to the angular orientation of the cam 108. As a result, the timing of the alignment of the fluid pathways of the fixed valve area profile 112 the fluid chambers 106 of the cylinder block 102 will remain fixed. However, when the pressure differential is non-zero, such as due to a torque applied to the motor, the angular orientation of the fixed valve area profile 112 may be shifted relative to the angular orientation of the cam 108 to either delay or advance the timing between the fixed valve area profile 112 and the cam 108, and the fluid pathways of the fixed valve area profile 112 and the fluid chambers 106. This approach reduces throttling during valve transition, providing advantages over conventional hydraulic pump-motors, such as improved efficiency, reduced nose, and reduced vibration.

Specific examples of motors 100 in accordance with embodiments of the present disclosure will be provided below. However, those skilled in art understand that embodiments of the pressure-shifted valve timing technique may be applied to other motor types that are not specifically described herein, but may generally be represented by the motor of FIG. 1.

Figure 2:
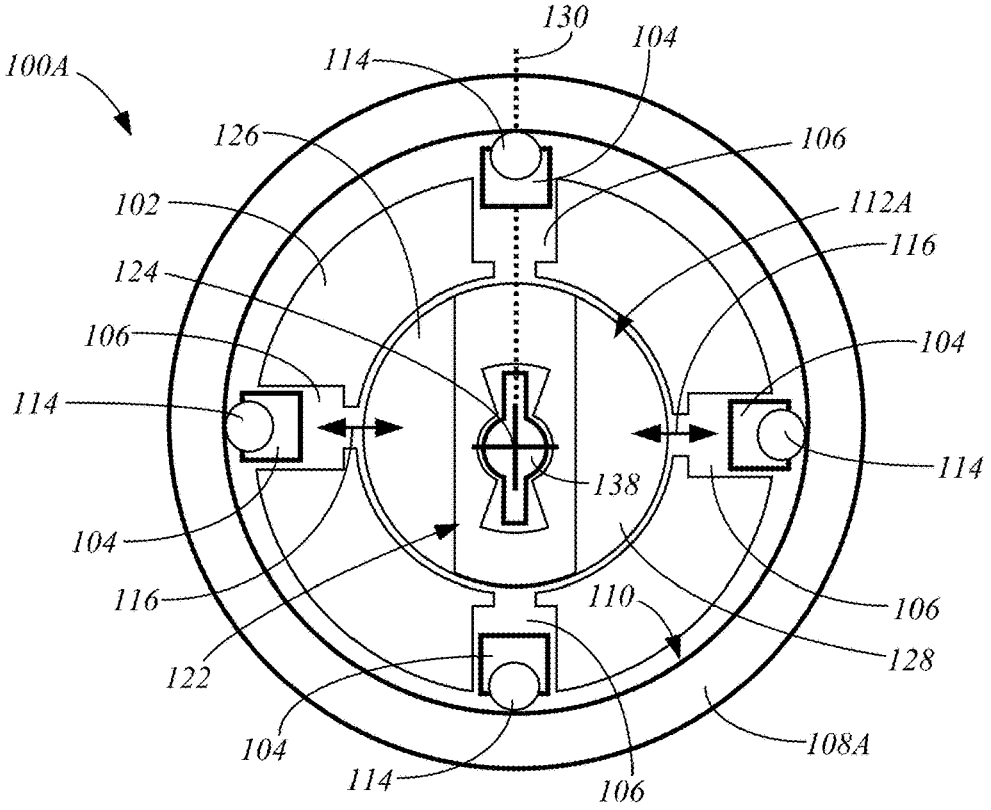
FIGS. 2 and 3 are simplified top cross-sectional views of an example of a hydraulic pump-motor in different operating states, in accordance with embodiments of the present disclosure.
Figure 3:
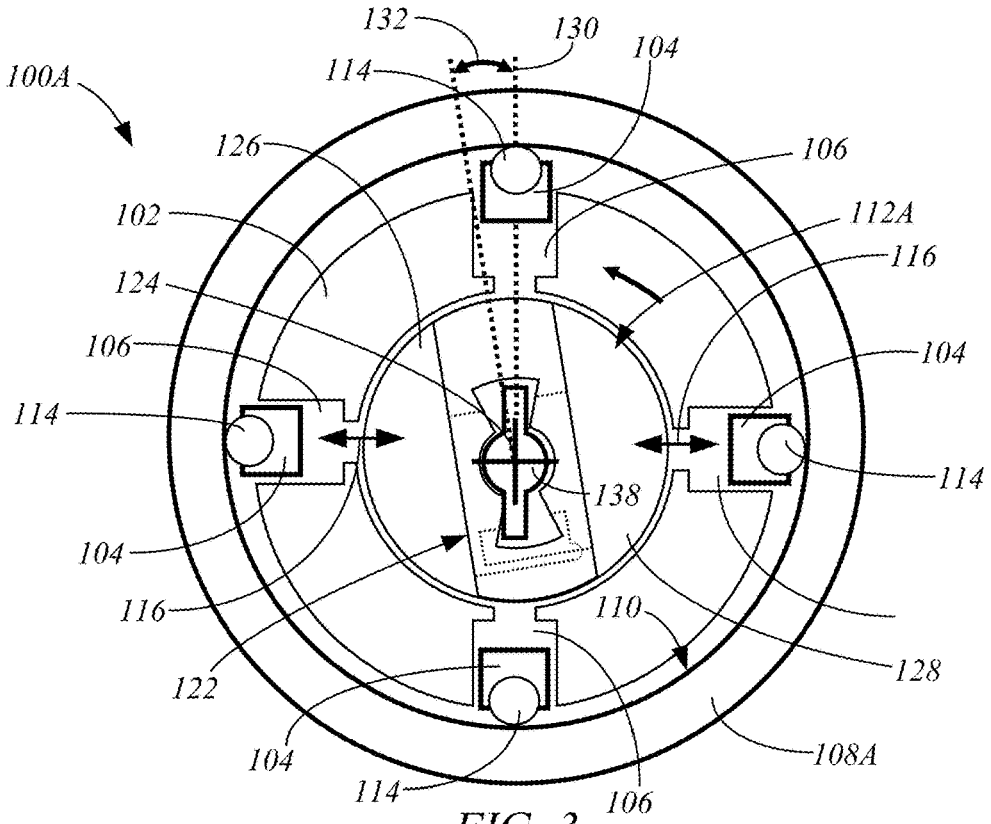

FIGS. 2 and 3 are simplified diagrams (e.g., top cross-sectional views) of an example of a radial hydraulic pump-motor (hereinafter "motor") 100A in two different states of operation, in accordance with embodiments of the present disclosure. In this example, the cam 108 comprises a radial cam 108A, and the fixed valve area profile 112 comprises a pintle 112A. During operation, the cylinder block 102 is rotated about the axis 124 relative to the cam 108 and the pintle 112A, and the cam surface 110 drives movement of the pistons 104 relative to their corresponding fluid chambers 106. This movement drives fluid flows 116 that are directed into one of the ports 118, 120 (FIG. 1) through corresponding fluid passageways 126 and 128 of the pintle 112A, as indicated in FIG. 2.

The timing adjustment actuator 122 operates to adjust the angular orientation (about the axis 124) of the fixed valve area profile 112 or pintle 112A relative to the angular orientation (about the axis 124) of the cam 108, based on the pressure differential between the ports 118 and 120 or the fluid passageways 126 and 128, which are linked to the ports 118 and 120. Thus, the pintle 112A may initially have an orientation with the cam 108 that is indicated by line 130 for a pressure differential that is in one direction (e.g., the pressure at the port 118 is greater than the pressure at the port 120), as indicated in FIG. 2. When the pressure differential switches direction, the timing adjustment actuator 122 adjusts the angular orientation of the pintle 112A relative to the angular orientation of the cam 108 by an angle 132, as indicated in FIG. 3. This changes the timing between the exposure of the fluid chambers 106 of the cylinder block 102 to the fluid passageways 126 and 128 of the pintle 112A.

Figure 4:
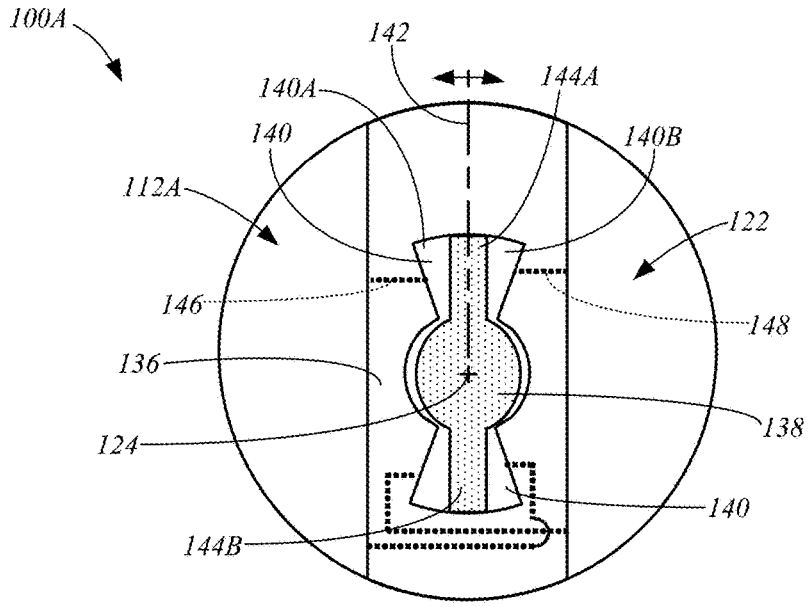
FIGS. 4-6 are simplified diagrams of a portion of the motor of FIGS. 2 and 3 illustrating an example of a timing adjustment actuator in different operating states, in accordance with embodiments of the present disclosure.
Figure 5:
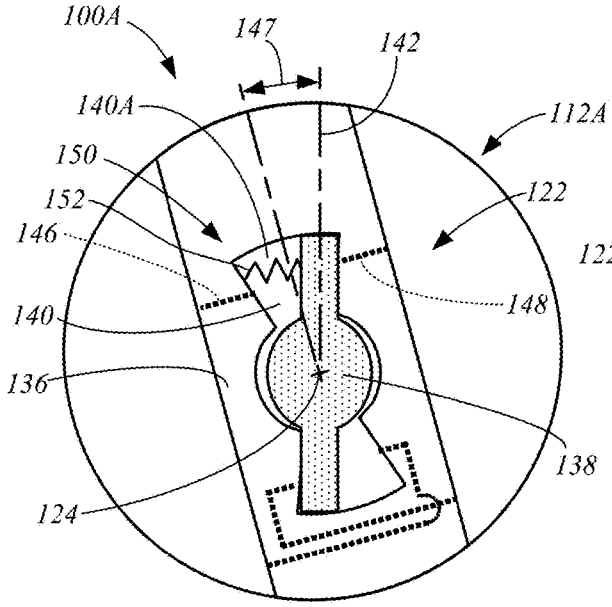
Figure 6:
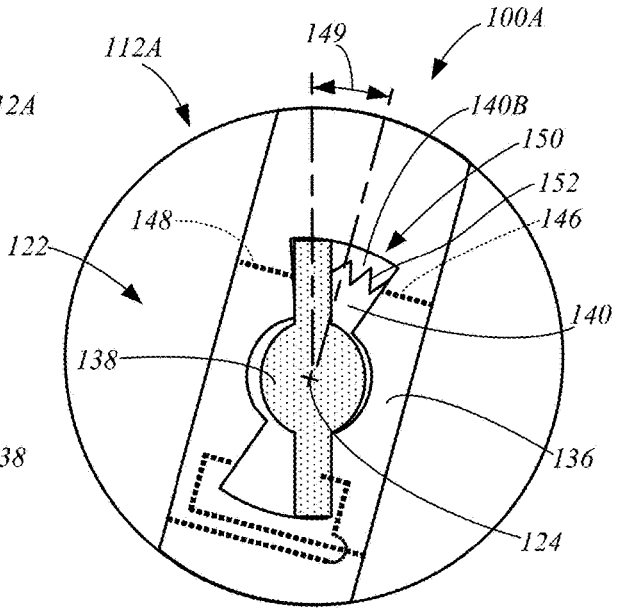

The timing adjustment actuator 122 may take on any suitable form. FIGS. 4-6 are simplified diagrams of a portion of the motor 100A illustrating different operating states of an example of the timing adjustment actuator 122 that may be used with the pintle 112A, in accordance with embodiments of the present disclosure. Some components of the motor 100A are not shown to simplify the drawings.

In one example, the timing adjustment actuator 122 includes a housing 136 that is connected to the fixed valve area profile 112, such as the pintle 112A, and a vane actuator 138 contained within an actuator chamber 140 of the housing 136. In one embodiment, the vane actuator 138 has a fixed angular orientation relative to the cam 108, which is represented by line 142, while the pintle and the housing are configured to rotate about the axis relative to the cam 108 and the vane actuator 138.

The vane actuator 138 includes a vane 144A that divides the actuator chamber 140 into an actuator chamber section 140A connected to the port 118, such as through the fluid passageway 126 as indicated by line 146, and an actuator chamber section 144B connected to the port 120, such as through the fluid passageway 128 as indicated by line 148. As indicated in the illustrated example, the vane actuator 138 may include more than one vane, such as a second vane 144B that similarly divides a lower actuator chamber 140 into actuator chamber sections that are each connected to one of the ports through the corresponding fluid passageways of the pintle 112A.

In some embodiments, when a non-zero pressure differential exists between the ports 118 and 120 and the fluid passageways 126 and 128, the higher pressure fluid is driven into the corresponding actuator chamber section, such as section 140A, while the lower pressure fluid is driven from the corresponding actuator chamber section, such as section 140B. This creates a pressure difference between the actuator chamber sections 140A and 140B that drives rotation of the pintle 112A about the axis 124 relative to the vane actuator 138 and cam 108. For example, the pintle 112A is driven about the axis 124 an angular distance 147 from the angular orientation 142 of the vane actuator 138 and the cam 108, as shown in FIG. 5, when the pressure at the fluid passageway 126 and port 118 corresponding to actuator chamber section 140A is greater than the pressure at the fluid passageway 128 and port 120 corresponding to actuator chamber section 140B. Likewise, rotation of the pintle 112A is driven about the axis 124 an angular distance 149 from the angular orientation 142 of the vane actuator 138 and the cam 108, as shown in FIG. 6, when the pressure at the fluid passageway 128 and the port 120 corresponding to actuator chamber section 140B is greater than the pressure at the fluid passageway 126 and the port 118 corresponding to actuator chamber section 140A. Thus, depending on the direction of the pressure differential, the angular orientation of the fixed valve area profile 112 (pintle 112A), may be driven by the timing adjustment actuator 122 to the orientation shown in FIG. 5 or 6 relative to the angular orientation of the cam 108 and the vane actuator 138.

In one embodiment, the fixed valve area profile 112 and the housing is biased to a particular angular orientation relative to the cam 108, such as the orientation shown in FIGS. 2 and 4. As a result, the fixed valve area profile 112 (pintle 112A) will rotate between the angular orientations shown in FIGS. 5 and 6 relative to the cam 108 and the vane actuator 138 in response to a direction and magnitude of a pressure differential between the ports 118, 120 or the fluid passageways 126, 128.

In one embodiment, a biasing mechanism 150 biases the fixed valve area profile 112 and the housing 136 to a particular orientation relative to the cam 108 and the vane actuator 138. For example, the pintle 112A and the housing 136 may be biased to the orientation shown in FIG. 4 where the vane actuator 138 is centrally positioned relative to the actuator chamber 140. In one embodiment, this aligns the angular orientation of the fixed valve area profile 112 with the cam 108 with a zero shift in timing, thereby arranging the fixed valve area profile 112 and cam 108 to operate somewhat conventionally (e.g., no offset). The timing adjustment actuator 122 adjusts the angular orientation of the fixed valve area profile 112 relative to the cam 108 toward the angular orientations shown in FIGS. 5 and 6 based on the direction and magnitude of the pressure differential. As a result, for small pressure differentials, the pintle 112A may rotate only slightly from the orientation shown in FIG. 4, while larger pressure differentials may drive the pintle 112A to the orientations shown in FIGS. 5 and 6. Accordingly, this arrangement allows for continuous adjustment to the angular orientation of the fixed valve area profile 112 relative to the cam 108 up to the extremes allowed by the timing adjustment actuator 122.

The biasing mechanism 150 may take on any suitable form, and generally operates to apply a torque on the fixed valve area profile 112 to resist the angular displacement of the fixed valve area profile 112 relative to the cam 108 driven by the pressure differential. In one example, the biasing mechanism 150 comprises one or more springs 152, as shown in FIGS. 5 and 6. The one or more springs 152 may take on any suitable form, such as a torsional spring. When the spring constant of the spring 152 is known, a known ratio of the angular displacement of the fixed valve area profile 112 relative to the cam 108 may be established.

It is understood that the function of the timing adjustment actuator 122 may be implemented using different techniques than those provided in the example discussed above. For instance, the timing adjustment actuator 122 may utilize a linear hydraulic actuator between the fixed valve area profile 112 and the cam 108 to create the desired timing and angular adjustment between the fixed valve area profile 112 and the cam 108. For example, the hydraulic actuator could be attached at a known radius and have a length that is determined by the pressure differential between the ports 118, 120 of the motor 100. The linear displacement created by the actuator would result in an angular displacement between the fixed valve area profile 112 and the cam 108. Springs could be used to create a desired ratio of pressure/force to angular displacement. The linear hydraulic actuator could be spring-centered in its stroke when the pressure differential is zero. Thus, the embodiments of the timing adjustment actuator 122 include these and other equivalent configurations.

Figure 7:
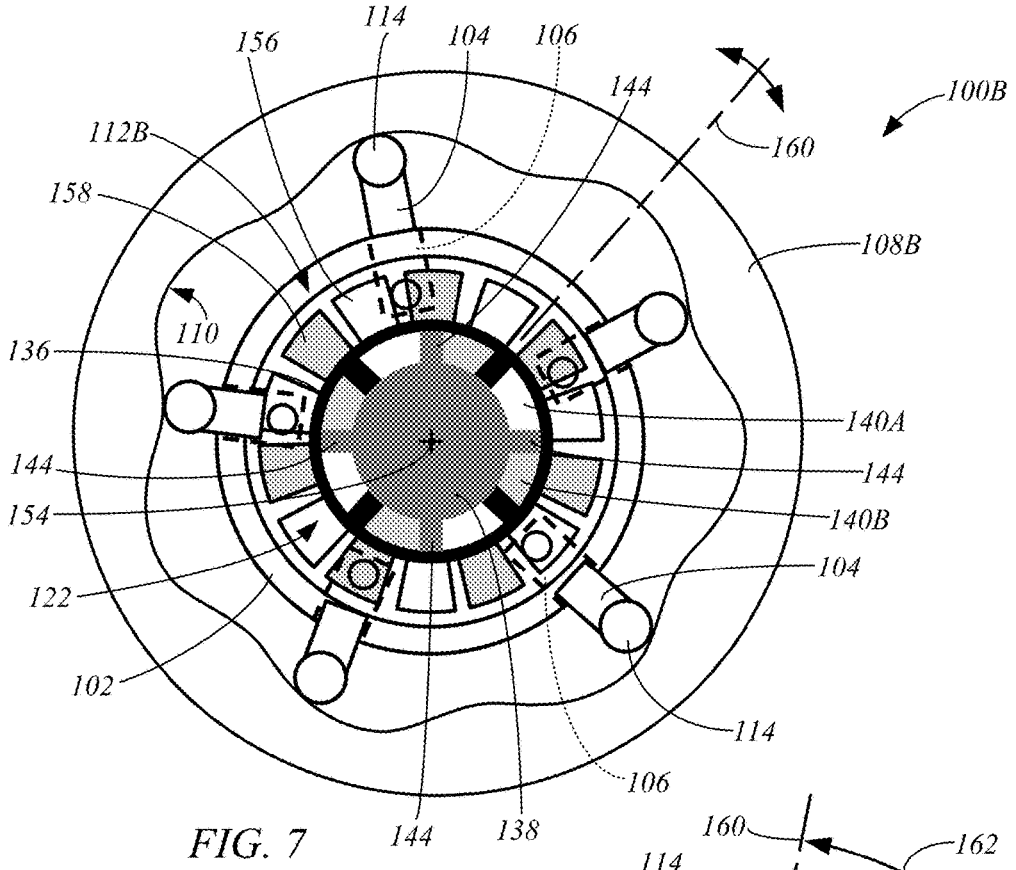
FIGS. 7-8 are simplified top cross-sectional views of a rotary hydraulic pump-motor in different operating states, in accordance with embodiments of the present disclosure.
Figure 8:
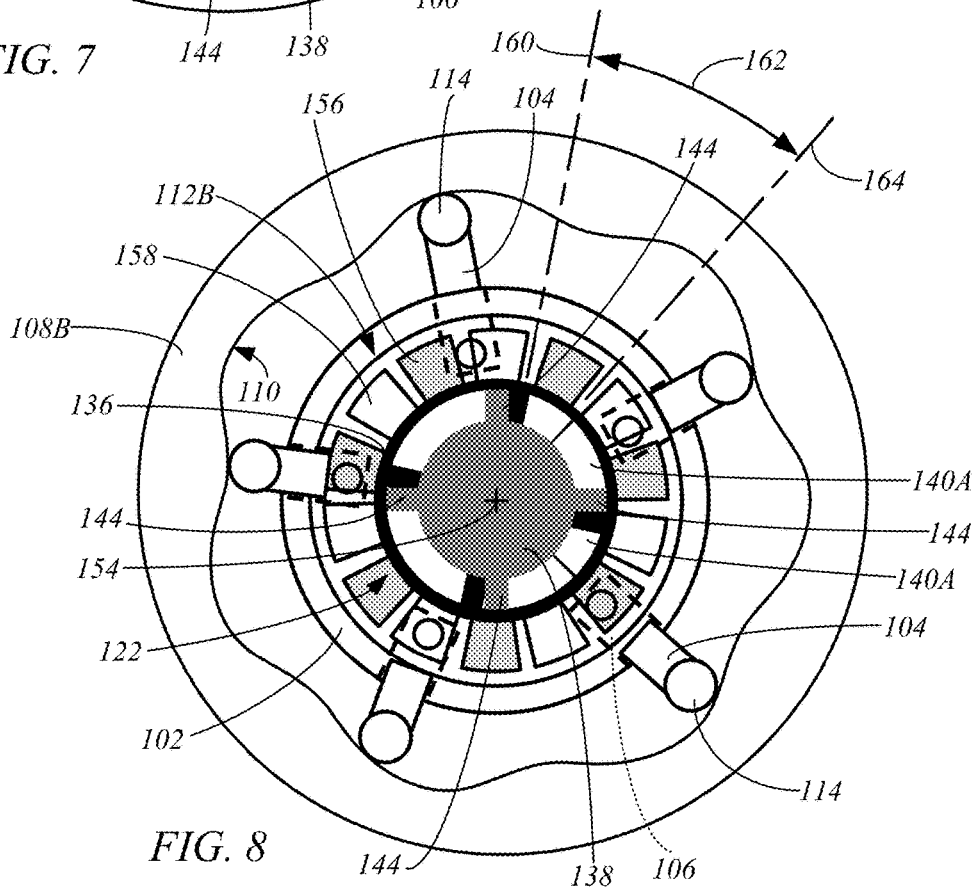

FIGS. 7 and 8 are simplified top cross-sectional views diagrams of a rotary hydraulic pump-motor (hereinafter "motor") 100B in different operating states, in accordance with embodiments of the present disclosure. The motor 100B generally operates in accordance with the motor 200 of FIGS. 13-14, but is equipped with a timing adjustment actuator 122 that allows the motor 100B to operate as describe with reference to FIG. 1. Accordingly, in this example, the cam 108 comprises a radial cam 108B, and the fixed valve area profile 112 comprises a disc valve 112B. During operation, the cylinder block 102 is rotated about the axis 154 relative to the cam 108B and the disc valve 112B, and the cam surface 110 drives movement of the pistons 104 relative to their corresponding fluid chambers 106. This movement drives fluid flows that are directed into the ports 118 and 120 (FIG. 1) through corresponding fluid passageways 156 and 158 of the disc valve 112B.

Due to the timing adjustment actuator 122, the angular orientation of the disc valve 112B may be adjusted relative to an angular orientation of the cam 108B about the axis 154 based on a pressure differential between the ports 118, 120 or the passageways 156, 158 of the disc valve 112B. Thus, the disc valve 112B may have an angular orientation relative to that of the cam 108B as indicated by line 160 in FIG. 7, that may be displaced relative to the cam 108B by an angle 162 to the angular orientation indicated by line 164 shown in FIG. 8. The disc valve 108B may be positioned in either of the orientations of FIGS. 7 and 8 depending on the direction of the pressure differential.

In accordance with the embodiments discussed above, the timing adjustment actuator 122 may bias the disc valve 108B toward a particular angular orientation relative to the angular orientation of the cam 108B (e.g., central position), such as in the orientation 160 shown in FIG. 7. In that case, the timing adjustment actuator 122 may allow the angular orientation of the disc valve 108B to be adjusted in either direction depending on the direction and magnitude of the pressure differential.

In the illustrated example, the timing adjustment actuator 122 may comprise a vane actuator 138 that operates substantially similarly to that discussed above with regard to the motor 100A and the actuator 122 shown in FIGS. 4-6, except that the housing 136 includes four actuator chambers 140, and the vane actuator 138 includes four vanes 144, one in each actuator chamber 140. Each vane 144 divides the corresponding actuator chamber 140 into an actuator chamber section 140A (unshaded) that is coupled to the port 118, and an actuator chamber section 140B (shaded) that is coupled to the port 120. Thus, the pressure differential between the ports 118, 120 is reflected within the actuator chamber sections 140, and drives rotation of the disc valve 112B about the axis 124 relative to the vane actuator 138 and the cam 108B in a similar manner as discussed above with regard to the motor 100A of FIGS. 2 and 3.

Figure 9:
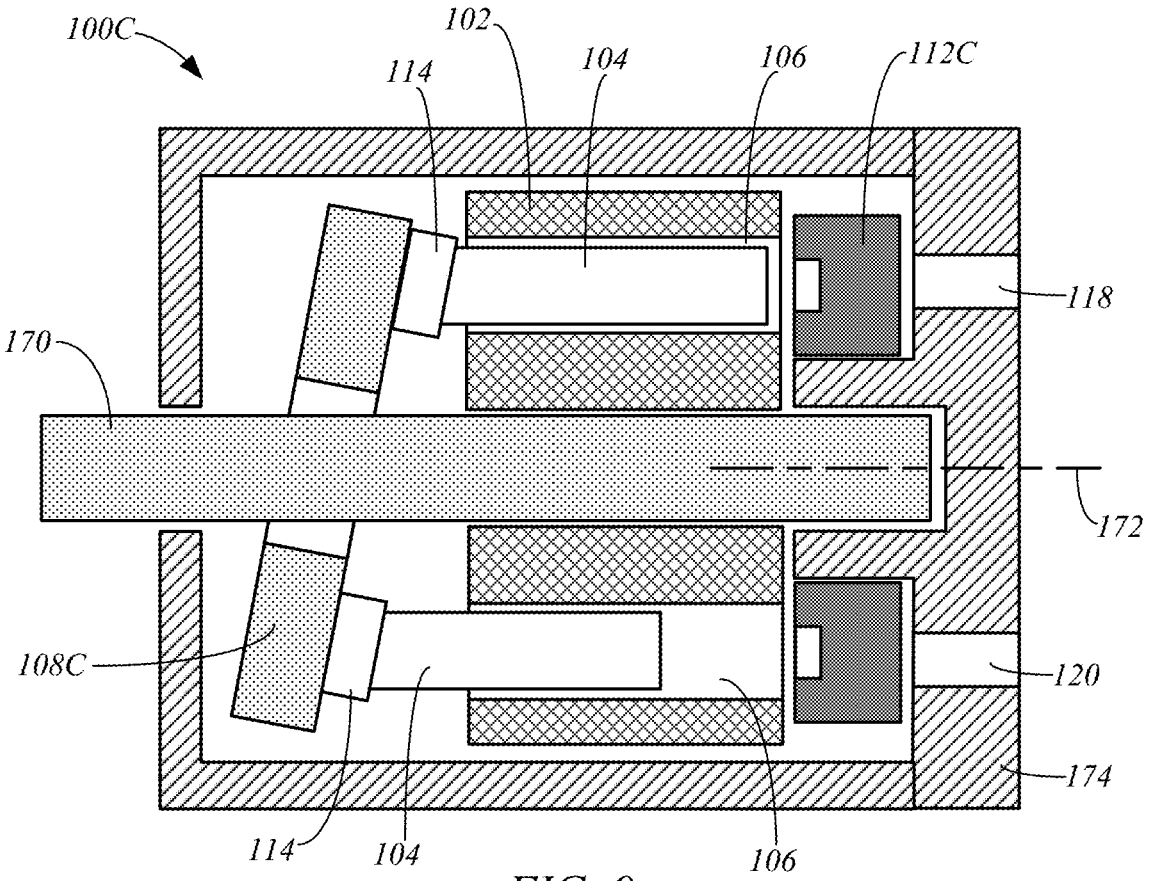
FIGS. 9 and 10 are simplified side and top cross-sectional views of an example of an axial hydraulic pump-motor, in accordance with embodiments of the present disclosure.
Figure 10:
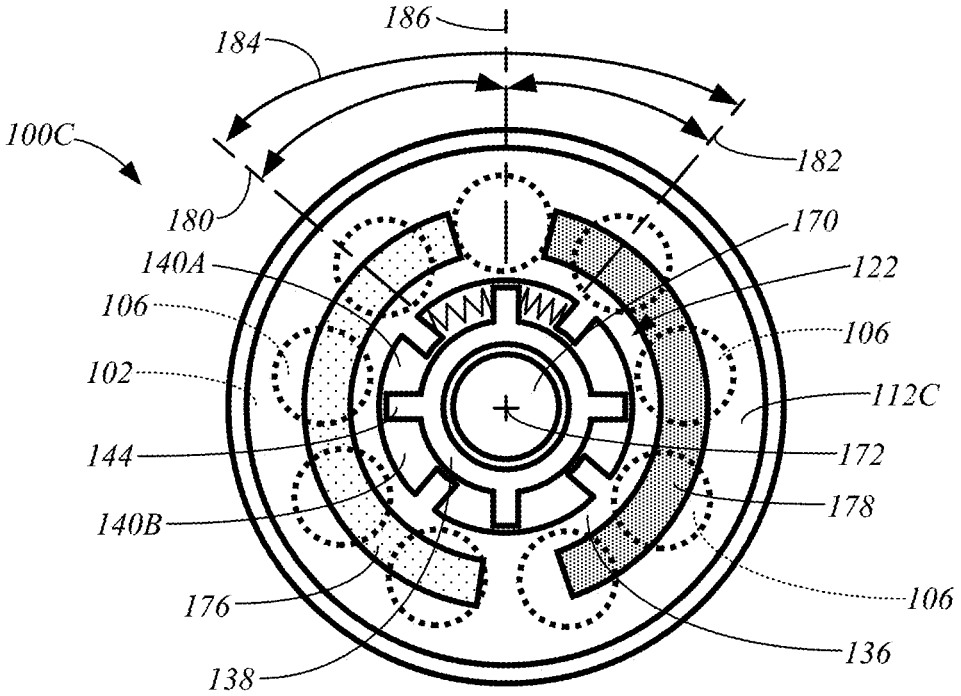

FIGS. 9 and 10 are simplified side and top cross-sectional views of an example of an axial hydraulic pump-motor (hereinafter "motor") 100C, in accordance with embodiments of the present disclosure. The motor 100C generally operates in accordance with conventional axial hydraulic pump-motors, except for the addition of the timing adjustment actuator 122, which is illustrated in FIG. 10.

The motor 100C includes a shaft 170 that rotates about an axis 172 and drives rotation of a cylinder block 102. Pistons 104 are contained in fluid chambers 106 of the cylinder block 102. In one embodiment, the motor 100C includes a cam 108 comprising a swash plate 108C having a cam surface 110 that engages cam followers 114 of the pistons 104, and drives movement of the pistons 104 relative to their corresponding fluid chambers 106 along the axis 154 in response to the rotation of the cylinder block 102 and the fluid chambers 106 relative to the swash plate 108C. It is understood that an alternative "cam" that may be used with the axial motor 100C includes a conventional bent axis and ball plate arrangement.

The motor 100C may utilize a fixed valve area profile 112 comprising a port plate 112C that directs fluid flows generated by the movement of the pistons 104 between the fluid chambers 106 and the ports 118 and 120 that may extend through a cover 174. The port plate 112C may include a fluid passageway 176 that connects fluid flows to the port 118, and a fluid passageway 178 that connects fluid flows to the port 120, as generally shown in FIG. 10.

The timing adjustment actuator 122 allows the angular orientation (about the axis 174) of the port plate 112C to be adjusted relative to an angular orientation (about the axis 174) of the swash plate 108C based on a pressure differential between the ports 118, 120 or the passageways 176, 178 of the port valve 112C. Thus, for example, the port valve 112C may have angular orientations relative to that of the swash plate 108C that align with lines 180 and 182, and span an angle 184, as indicated in FIG. 10. The port valve 112C may switch between these orientations based on a direction of the pressure differential between the ports 118 and 120.

In accordance with the embodiments discussed above, the timing adjustment actuator 122 may bias the port valve 112C toward a particular angular orientation relative to the angular orientation of the swash plate 108C, such as in a substantially central orientation that is aligned with the line 186 (FIG. 10), using a suitable biasing mechanism (e.g., spring). In that case, the timing adjustment actuator 122 may allow the angular orientation of the port valve to be adjusted in either direction from the orientation 186 depending on the direction and magnitude of the pressure differential.

In the illustrated example of the motor 100C of FIG. 10, the timing adjustment actuator 122 takes the form of a vane actuator 138 that operates substantially similarly to that discussed above with regard to the motor 100B shown in FIGS. 7 and 8, where the housing 136 includes four actuator chambers 140, and the vane actuator 138 includes four vanes 144, one in each actuator chamber 140 to divide each actuator chamber 140 into actuator chamber sections 140A and 140B. The pressures at the port 118 may be fed to the chamber section 140A, and the pressure at the port 120 may be fed to the chamber section 140B. The pressure difference operates to adjust the angular orientation of the port plate 112C relative to the swash plate 108C either toward the orientation 180 or toward the orientation 182 depending on the direction of the pressure differential, and the magnitude of the pressure differential when the biasing mechanism is used.

Figure 11:
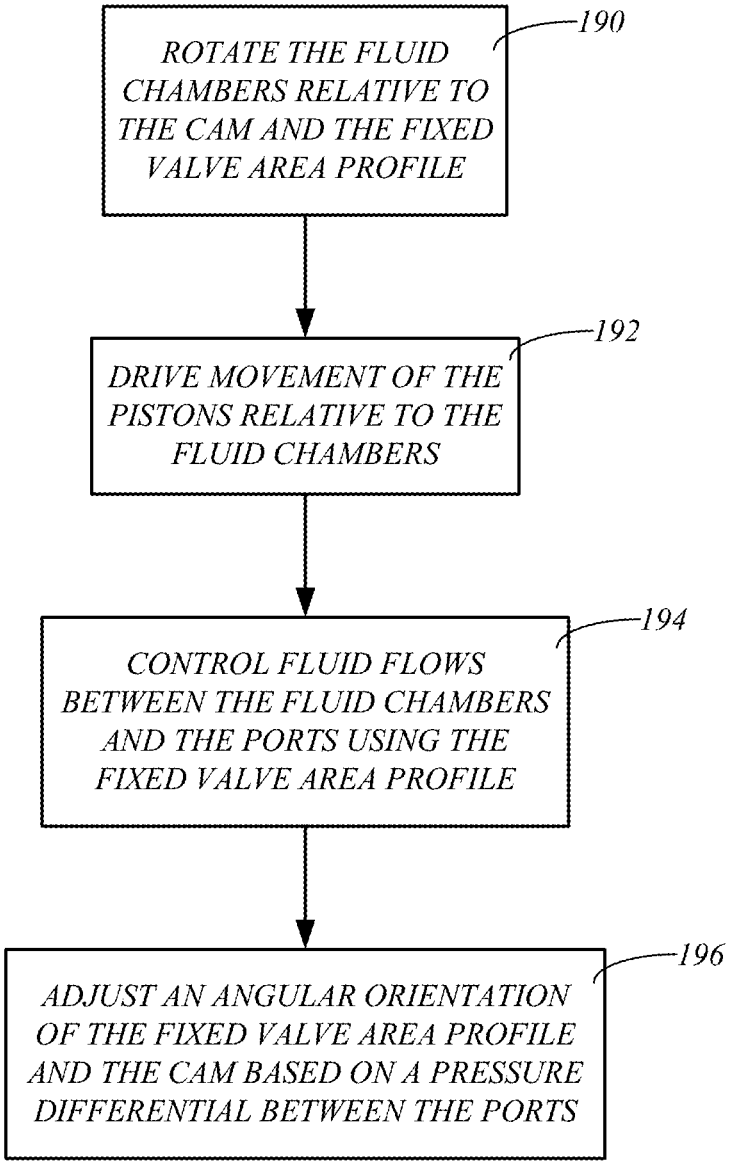
FIG. 11 is a flowchart illustrating an example of a method of operating a hydraulic pump-motor, in accordance with embodiments of the present disclosure.

Additional embodiments of the present disclosure are directed to methods of operating the hydraulic pump-motor having the timing adjustment actuator 122. FIG. 11 is a flowchart illustrating an example of a method operating a hydraulic pump-motor, in accordance with embodiments of the present disclosure. The method applies to the motors 100 and 100A-C described herein, but may be equally applicable to other motor types having a timing adjustment actuator 122. In one example, the method applies to a hydraulic pump-motor 100 that includes the cylinder block 102 having a plurality of fluid chambers 106, a piston 104 in each of the fluid chambers 106, a cam 108 having a cam surface 110 that engages the pistons 104 (such as through cam followers attached to the pistons), a fixed valve area profile 112 configured to control fluid flows between the fluid chambers 106 and first and second ports 118, 120, and a timing adjustment actuator 122, in accordance with the embodiments described above.

At 190 of the method, the cylinder block 102 and the plurality of fluid chambers 106 are rotated relative to the cam 108 and the fixed valve area profile 112. Here, it is understood that the cylinder block 102 may be rotatably driven about an axis, such as in the motors 100A and 100C described above, or the cam 108 and the fixed valve area profile 112 may be rotatably driven about an axis, such as in the motor 100B described above.

At 192 of the method, movement of each of the pistons 104 relative to the corresponding fluid chamber 106 is driven in response to the rotating step 190.

At 194, fluid flows driven by the movement of the pistons 104 are controlled (e.g., routed) between the fluid chambers 106 and the ports 118, 120 using the fixed valve area profile 112.

At 196 of the method, an angular orientation of the fixed valve area profile 112 relative to an angular orientation of the cam 108 is adjusted during the rotating step 190 using the timing adjustment actuator 122 based on a pressure differential between a pressure at the port 118 and a pressure at the port 120. In some embodiments, this adjustment to the angular orientation of the fixed valve area profile 112 is based on a direction of the pressure differential, or a direction and magnitude of the pressure differential.

Although the embodiments of the present disclosure have been described with reference to preferred embodiments, workers skilled in the art will recognize that changes may be made in form and detail without departing from the spirit and scope of the present disclosure.

What is claimed is:

1. A hydraulic pump-motor comprising:

a cylinder block including a plurality of fluid chambers;

a piston in each of the fluid chambers;

a cam having a cam surface that engages the pistons and drives movement of the pistons relative to the fluid chambers in response to relative rotation between the cam and the fluid chambers;

a fixed valve area profile configured to control fluid flows between the fluid chambers and first and second ports during rotation of the fluid chambers relative to the cam and the fixed valve area profile; and a timing adjustment actuator configured to adjust an angular orientation of the fixed valve area profile relative to an angular orientation of the cam based on a pressure differential between a pressure at the first port and a pressure at the second port, during rotation of the cam and the fixed valve area profile relative to the fluid chambers.

2. The hydraulic pump-motor of claim 1, wherein the timing adjustment actuator drives the fixed valve area profile toward a first or second angular orientation relative to the angular orientation of the cam based on the direction of the pressure differential.

3. The hydraulic pump-motor of claim 2, wherein:

the timing adjustment actuator comprises:

a housing connected to the fixed valve area profile; and a vane actuator contained within an actuator chamber of the housing, the vane actuator having a fixed angular orientation relative to the cam, and dividing the actuator chamber into a first actuator chamber section connected to the first port and a second actuator chamber section connected to the second port; and a non-zero pressure differential between the first and second ports creates a net pressure difference between the first and second actuator chambers and drives rotation of the fixed valve area profile and the housing toward the first angular orientation or the second angular orientation relative to the vane actuator and the cam based on the direction of the pressure differential.

4. The hydraulic pump-motor of claim 3, wherein the timing adjustment actuator is configured to drive the fixed valve area profile toward the first angular orientation or the second angular orientation relative to the angular orientation of the cam based on the direction and magnitude of the pressure differential, and return the fixed valve area profile to a third angular orientation relative to the angular orientation of the cam when the pressure differential is zero.

5. The hydraulic pump-motor of claim 4, wherein first and second angular orientations of the fixed valve area profile are each angularly offset in opposite directions from the third angular orientation.

6. The hydraulic pump-motor of claim 5, wherein:

the timing adjustment actuator includes a biasing mechanism configured to bias the fixed valve area profile and the housing in the third angular orientation relative to the angular orientation of the cam; and the non-zero pressure differential drives rotational movement of the fixed valve area profile relative to the cam from the third angular orientation toward the second or third angular orientation.

7. The hydraulic pump-motor of claim 1, wherein:

the plurality of fluid chambers are in a radial configuration;

the cam comprises a radial cam having the cam surface that engages the pistons and drives radial movement of the pistons relative to the fluid chambers in response to relative rotation between the radial cam and the fluid chambers;

the fixed valve area profile comprises a disc valve configured to control fluid flows between the fluid chambers and the first and second ports during rotation of the radial cam and the disc valve relative to the fluid chambers; and the timing adjustment actuator is configured to adjust an angular orientation of the disc valve relative to an angular orientation of the radial cam based on the pressure differential during rotation of the radial cam and the disc valve relative to the fluid chambers.

8. The hydraulic pump-motor of claim 1, wherein:

the plurality of fluid chambers are in a radial configuration;

the cam comprises a radial cam having the cam surface that engages the pistons and drives radial movement of the pistons relative to the fluid chambers in response to relative rotation between the fluid chambers and the radial cam;

the fixed valve area profile comprises a pintle configured to control fluid flows between the fluid chambers and the first and second ports during rotation of the fluid chambers relative to the radial cam and the pintle; and the timing adjustment actuator is configured to adjust an angular orientation of the pintle relative to an angular orientation of the radial cam based on the pressure differential during rotation of the fluid chambers relative to the radial cam and the pintle.

9. The hydraulic pump-motor of claim 1, wherein:

the plurality of fluid chambers are in an axial configuration;

the cam surface drives axial movement of the pistons relative to the fluid chambers in response to relative rotation between the cam and the fluid chambers;

the fixed valve area profile comprises a port plate configured to control fluid flows between the fluid chambers and the first and second ports during rotation of the fluid chambers relative to the cam and the port plate; and the timing adjustment actuator is configured to adjust an angular orientation of the port plate relative to the cam based on the pressure differential during rotation of the fluid chambers relative to the cam and the port plate.

10. A hydraulic pump-motor comprising:

a cylinder block including a plurality of fluid chambers;

a piston in each of the fluid chambers;

a cam having a cam surface that engages the pistons and drives movement of the pistons relative to the fluid chambers in response to relative rotation between the cam and the fluid chambers;

a fixed valve area profile configured to control fluid flows between the fluid chambers and first and second ports during rotation of the fluid chambers relative to the cam and the fixed valve area profile; and a timing adjustment actuator comprising:

a housing connected to the fixed valve area profile; and a vane actuator contained within an actuator chamber of the housing, the vane actuator having a fixed angular orientation relative to the cam, and dividing the actuator chamber into a first actuator chamber section connected to the first port and a second actuator chamber section connected to the second port, wherein a non-zero pressure differential between the first and second ports creates a net pressure difference between the first and second actuator chambers and adjusts an angular orientation of the fixed valve area profile relative to an angular orientation of the cam during rotation of the cam and the fixed valve area profile relative to the fluid chambers.

11. The hydraulic pump-motor of claim 10, wherein the timing adjustment actuator drives the fixed valve area profile to a first or second angular orientation relative to the angular orientation of the cam based on the direction of the pressure differential.

12. The hydraulic pump-motor of claim 11, wherein the timing adjustment actuator is configured to drive the fixed valve area profile toward the first angular orientation or the second angular orientation relative to the angular orientation of the cam based on the direction and magnitude of the pressure differential, and return the fixed valve area profile to a third angular orientation relative to the angular orientation of the cam when the pressure differential is zero.

13. The hydraulic pump-motor of claim 12, wherein first and second angular orientations are each angularly offset from the first angular orientation in opposite directions.

14. The hydraulic pump-motor of claim 12, wherein:

the timing adjustment actuator includes a biasing mechanism configured to bias the fixed valve area profile and the housing in the third angular orientation relative to the angular orientation of the cam; and the non-zero pressure differential drives rotational movement of the fixed valve area profile relative to the cam from the third angular orientation toward the second or third angular orientation.

15. The hydraulic pump-motor of claim 10, wherein:

the plurality of fluid chambers are in a radial configuration;

the cam comprises a radial cam having the cam surface that engages the pistons and drives radial movement of the pistons relative to the fluid chambers in response to relative rotation between the radial cam and the fluid chambers;

the fixed valve area profile comprises a disc valve configured to control fluid flows between the fluid chambers and the first and second ports during rotation of the radial cam and the disc valve relative to the fluid chambers; and the timing adjustment actuator is configured to adjust an angular orientation of the disc valve relative to an angular orientation of the radial cam based on the pressure differential during rotation of the radial cam and the disc valve relative to the fluid chambers.

16. The hydraulic pump-motor of claim 10, wherein:

the plurality of fluid chambers are in a radial configuration;

the cam comprises a radial cam having the cam surface that engages the pistons and drives radial movement of the pistons relative to the fluid chambers in response to relative rotation between the fluid chambers and the radial cam;

the fixed valve area profile comprises a pintle configured to control fluid flows between the fluid chambers and the first and second ports during rotation of the fluid chambers relative to the radial cam and the pintle; and the timing adjustment actuator is configured to adjust an angular orientation of the pintle relative to an angular orientation of the radial cam based on the pressure differential during rotation of the fluid chambers relative to the radial cam and the pintle.

17. The hydraulic pump-motor of claim 10, wherein:

the plurality of fluid chambers are in an axial configuration;

the cam surface drives axial movement of the pistons relative to the fluid chambers in response to relative rotation between the cam and the fluid chambers;

the fixed valve area profile comprises a port plate configured to control fluid flows between the fluid chambers and the first and second ports during rotation of the fluid chambers relative to the cam and the port plate; and the timing adjustment actuator is configured to adjust an angular orientation of the port plate relative to the cam based on the pressure differential during rotation of the fluid chambers relative to the cam and the port plate.

18. A method of operating a hydraulic pump-motor, wherein:

the hydraulic pump motor comprises:

a cylinder block including a plurality of fluid chambers;

a piston in each of the fluid chambers;

a cam having a cam surface that engages the pistons;

a fixed valve area profile configured to control fluid flows between the fluid chambers and first and second ports; and a timing adjustment actuator; and the method comprises:

rotating the plurality of fluid chambers relative to the cam and the fixed valve area profile;

driving movement of the pistons relative to the fluid chambers in response to the rotating;

controlling fluid flows driven by the movement of the pistons between the fluid chambers and the first and second ports during the rotating using the fixed valve area profile; and adjusting an angular orientation of the fixed valve area profile relative to an angular orientation of the cam during the rotating using the timing adjustment actuator based on a pressure differential between a pressure at the first port and a pressure at the second port.

19. The method of claim 18, wherein adjusting the angular orientation of the fixed valve area profile relative to the angular position of the cam includes driving the fixed valve area profile to a first or second angular orientation relative to the angular orientation of the cam based on the direction of the pressure differential.

20. The method of claim 19, wherein:

the timing adjustment actuator comprises:

a housing connected to the fixed valve area profile; and a vane actuator contained within an actuator chamber of the housing, the vane actuator having a fixed angular orientation relative to the cam, and dividing the actuator chamber into a first actuator chamber section connected to the first port and a second actuator chamber section connected to the second port; and a non-zero pressure differential between the first and second ports creates a net pressure difference between the first and second actuator chambers and drives rotation of the fixed valve area profile and the housing toward the first or second angular orientation relative to the vane actuator and the cam based on the direction of the pressure differential.

* * * * *